US005940916A

United States Patent [19]

Sauvageot

[11] Patent Number: 5,940,916

[45] Date of Patent: Aug. 24, 1999

[54] BRIDGE SPAN-BY-SPAN CONSTRUCTION APPARATUS AND METHOD

[75] Inventor: Gerard A. Sauvageot, San Diego, Calif.

[73] Assignee: J. Muller International, San Diego, Calif.

[21] Appl. No.: 08/922,778

[22] Filed: Sep. 3, 1997

[51] Int. Cl.[6] ..... E01D 21/00

[52] U.S. Cl. ..... 14/2.5; 14/77.1

[58] Field of Search ..... 14/2.4, 2.5, 77.1

[56] References Cited

U.S. PATENT DOCUMENTS 5,042,102 8/1991 Kahmann et al. ..... 14/2.5 X 5,511,266 4/1996 Dinis ..... 14/2.5

*Primary Examiner*—James A. Lisehora

*Attorney, Agent, or Firm*—Baker & Maxham

[57] ABSTRACT

An apparatus for span-by-span bridge construction, comprises an elongated girder assembly for spanning between adjacent bridge piers for supporting precast bridge segments during assembly, pier brackets for attachment to a pier shaft, the brackets having rollers for support of the girder assembly for movement between piers, and at least one carriage vehicle for engagement with top rail tracks on the girder assembly, the vehicle moveable between a working position of supporting the bridge segments during assembly of multiple segments and a stowage position.

19 Claims, 13 Drawing Sheets

BRIDGE SPAN-BY-SPAN CONSTRUCTION APPARATUS AND METHOD

BACKGROUND OF THE INVENTION

The present invention relates to bridge and viaduct construction and pertains particularly to apparatus and methods for precast segmental span-by-span bridge construction.

The current technology used for rail and highway bridge construction includes span-by-span post tensioned precast concrete segmental construction. A typical bridge structure is defined cross-sectionally by a central load bearing span or web member and a pair of lateral wing or platform structures mounted to either side of the central load bearing body. The wings or lateral platform structures carry one or more lanes or tracks for vehicles on either side of the central body member. The bridge structure is supported between vertically extending piers positioned below the central body member.

A typical example of various bridge segments and a unique method for post-tensioning segmental bridge or viaduct structures are disclosed in U.S. Pat. No. 5,437,072 entitled RAPID TRANSIT VIADUCT WITH POST-TENSIONING CABLE SYSTEM, and of common assignment herewith. That patent is incorporated herein by reference as though fully set forth.

The techniques of construction of pre-cast concrete span-by-span bridges have been carried out in many ways. The different techniques normally employ various support structures normally involving girders and cranes and other equipment for supporting and handling the bridge segments. The precast segments can be supported during construction either from the top or from the bottom. When supported from the top, they hang under an overhead erection truss. When supported from the bottom, they rest on an underdeck erection truss.

One example of a girder support is illustrated in U.S. Pat. No. 5,386,782 entitled RAPID TRANSIT VIADUCT SYSTEM WITH CENTRAL PLATFORM STATION, of common assignment herewith, and incorporated herein by reference as though fully set forth. This system discloses the use of two parallel laterally spaced trusses used to support the segments under the wings, very close to the webs. The trusses rest on pier brackets secured to the top of the pier shaft and equipped with rollers to launch the trusses to the next pier.

Another erection or construction system is disclosed in U.S. Pat. No. 5,511,266, assigned to assignee hereof, which discloses a viaduct construction system wherein an erection girder spans and moves between viaduct piers for supporting structure and precast segments during assembly. This patent also discloses several examples of related prior art, and is incorporated herein by reference as though fully set forth.

The precast segments as previously pointed out can be supported during, construction either from the top or from the bottom. When supported from the top, they hang under an overhead erection truss which must be disassembled for movement from the piers of one span to the piers of the next span. When supported from the bottom, they rest on an underdeck erection truss which, if properly constructed and supported can be moved between piers without disassembly.

There is a need for an improved erection system and method which can easily move from span to span without disassembly for a substantially continuous assembly process.

SUMMARY OF THE INVENTION

In accordance with a primary aspect of the present invention, an apparatus for span-by-span bridge construction, comprises an elongated girder assembly for spanning between adjacent bridge piers for supporting precast bridge segments during assembly, pier bracket means for attachment to a pier shaft and having roller means for engagement with and support of said girder assembly for enabling movement between piers, and a carriage vehicle on said girder assembly moveable between a working position of supporting the bridge segments during assembly of multiple segments and a stowage position. Another aspect of the invention includes a powered carriage for propelling the girder apparatus to a next span to continue bridge assembly.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF A PREFERRED EMBODIMENT

Figure 1:
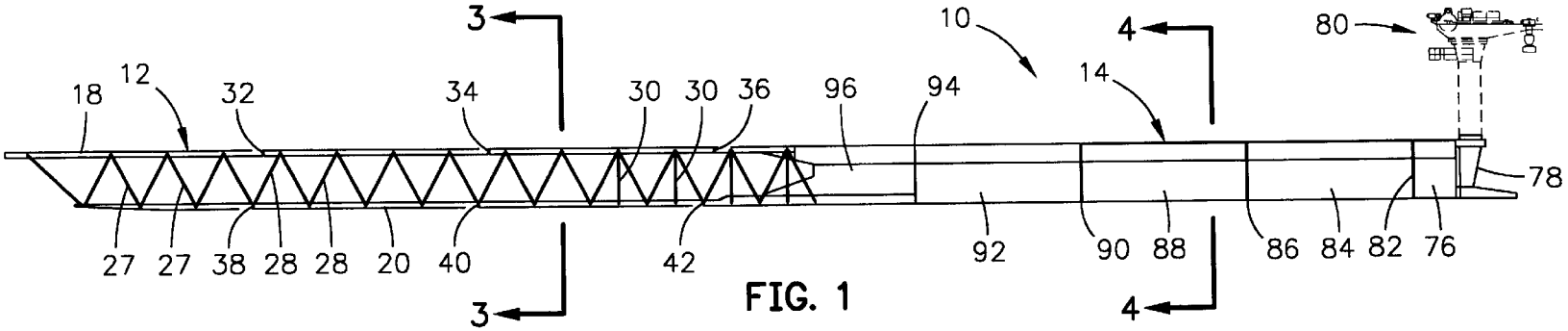
Fig. 1 is a side elevation view of an assembly in accordance with a preferred embodiment of the invention.

Referring now to the drawings with particular reference to FIGS. 1–4, an exemplary embodiment of a girder assembly apparatus for the construction of bridges from segmented precast segments in accordance with the invention is illustrated and designated generally by the numeral 10. The apparatus generally comprises an elongated girder assembly designed to span the space between at least two pairs of bridge piers normally made up of three piers in a row. The apparatus comprises two main girder sections comprising a truss girder section designated generally by the numeral 12 designed to span a first and a second bridge pier and a plate girder section designated generally at 14 designed to span between the second bridge pier and a third bridge pier.

Figure 2:
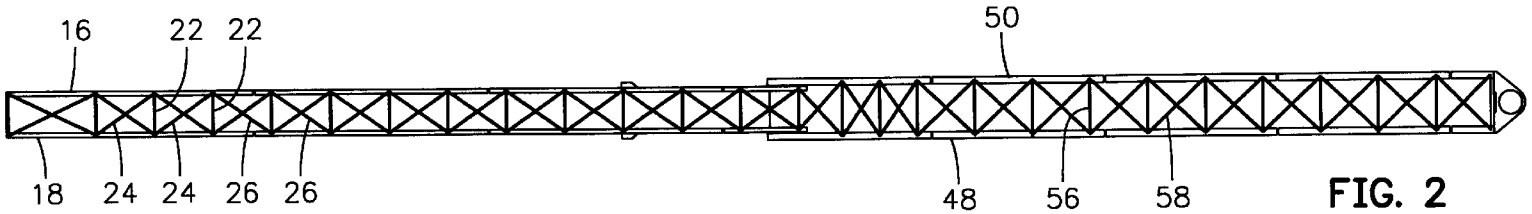
FIG. 2 is a top plan view of the embodiment of FIG. 1.
Figure 3:
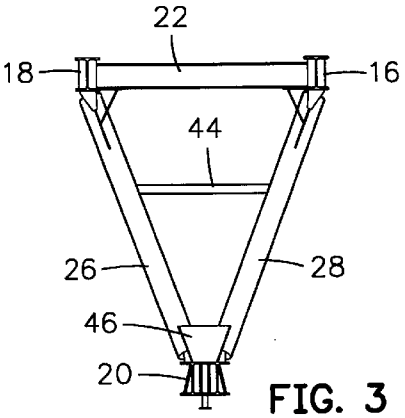
FIG. 3 is a section view taken on line 3—3 of FIG. 1.

As seen in FIGS. 1 and 2, the truss girder section is formed of an open beam or truss assembly or arrangement having a pair of upper or top elongated beams 16 and 18 connected together by a plurality of cross beams and to a lower elongated beam 20 by a plurality of cross beams. This arrangement as seen in FIG. 3 forms a generally V cross-section which, as will be explained later, sits or rests within a gap formed by the upper Y section of a bridge or viaduct pier. The upper beams 16 and 18 may be either I or H beams and are connected together by a plurality of transverse beams 22 and a plurality of cross beams 24 and 26. A plurality of angled beams 26 and 28 connect at the respective upper beams 16 and 18 to the lower beam 20 along the links of the span. A plurality of vertical beams 30 at one end near the connection or transition to the plate section extend or connect between the upper beams and the lower beam.

The truss girder section is made up of a plurality of truss segments which are connected together at upper type F field splices 32, 34 and 36, and lower type G field splices 38, 40 and 42. These type of splices are well known in the art and need no further description or explanation. This section is also provided with a chassis or carriage storage platform 44 and a walk or walkway 46. This section functions primarily as a support section and also provides some storage for working chassis or carriages subsequently described.

Figure 4:
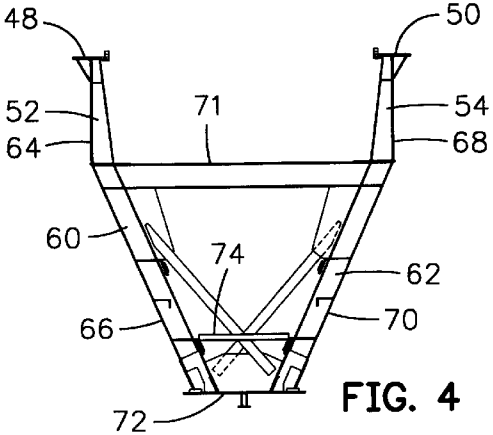
FIG. 4 is a section view taken on line 4—4 of FIG. 1.

The plate girder section 14, as best seen in FIGS. 2 and 4, is formed by large steel plates 64 and 66 on one side and 68 and 70 on the other into a large box beam with conventional beams or posts forming stiffers and bracing. Stiffening and bracing is provided by a pair of spaced apart beams or web plates 48 and 50 secured to vertically extending stiffening posts or pillars 52 and 54, above a lower trapezoidal girder section. This upper section is formed by plurality of transverse beams 56 and a plurality of cross beams 58, extending between the side steel web plates and connected to the upper ends of angled beams 60 and 62 (FIG. 4). This forms a giant beam structure by upper and lower side web plates 64 and 66 on one side, and 68 and 70 on the other side. The plates form the load supporting structure stiffened by the framework. A top plate 71 rests on and is stiffened by the cross beams and a bottom plate 72 connects at the lower ends of the side plates and provides a floor for the section. The plates form the base carrying structure or beam of this section as well as forming an enclosed work space. This construction forms a substantially enclosed box beam construction which also forms an enclosed work area for the workers. This improves the safety of the workers by preventing them from falling to the ground or other surface below. It also protects the public from falling tools and other debris.

The upper surface of the two spaced apart beams 48 and 50 form tracks on which rollers of the carriage assembly run to support the bridge segments. They also each have a gear rack extending the length thereof for driving engagement by driving gears on a powered carriage as will be explained. The plate 71 forms a support surface on which the carriages are supported for storage and on which workers walk in assembling the structure. A lower plate 74 forms a walkway, which may also be supported on a cross beam structure, provides a walkway for workers. Additional bracing structure may also be provided, as illustrated in FIG. 4, for enhancing the strength and rigidity of the structure. This may be in the form of reinforcement plates, gussets and cross beams or braces, as illustrated.

As best seen in FIG. 1, the plate girder section is made up of a plurality of segments including an end segment or diaphragm segment 76 having a swivel crane support structure 78 for supporting a swivel crane 80. The end segment 76 is connected by a type B field splice 82 to a plate girder section 84 which in turn is connected by a type C field splice 86 to a plate girder segment 88. This segment 88 is connected by a type D field splice 90 to a segment 92. This segment 92 is then connected by a type E field splice 94 to one end of a transition segment 96. These type of field splices are well known in the art and need no further explanation or description. The transition segment has portions of both the truss girder section and the plate girder section and normally rests on a center pier, as will be subsequently discussed.

These sections of the girder assembly are each made up of multiple segments of predetermined length which can be transported to and assembled in the field to make up a girder assembly of the desired length to span the necessary distance between bridge piers. The girder assembly may be changed in length as span lengths may change for a given bridge structure.

Figure 5:
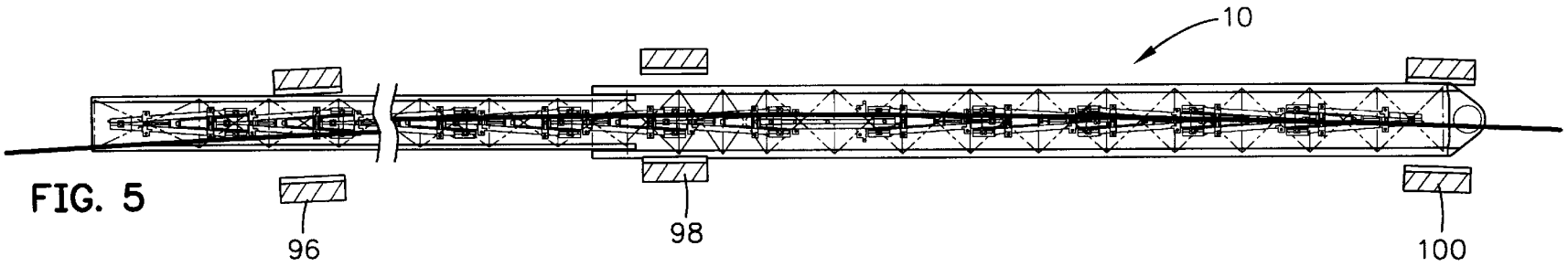
FIG. 5 is a top plan view of the embodiment of FIG. 1, showing the vehicles in a stowed position.
Figure 6:
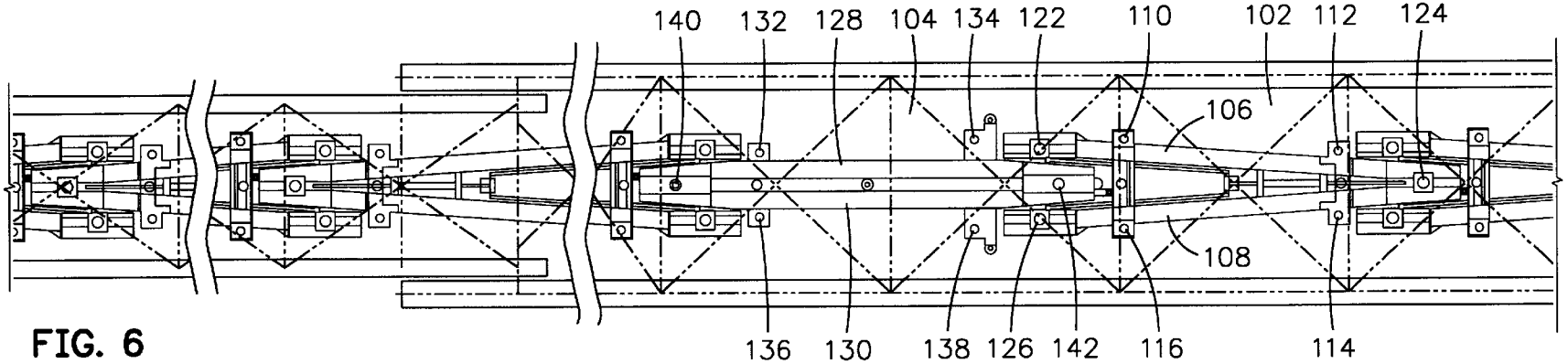
FIG. 6 is a enlarged detailed view of a portion of the assembly of FIG. 5.

Referring now to FIG. 5, an erection apparatus 10 is shown in top plan view supported between a series of piers 96, 98 and 100. The apparatus is shown with its ends supported in the outer most piers 96 and 100 with the center section, which is the transition between the plate girder section and the truss girder section, supported on the center pier 98. As can be seen in FIGS. 5 and 6, a plurality of carriages are shown in the stowed position. In the illustrated arrangement, the plurality of carriages illustrate two types of carriages with the first and most predominant type designated generally by the numeral 102, being of a generally V configuration in plan view. This type is referred to as a standard chassis carriage. A second type referred to as a short chassis carriage, and designated generally by the numeral 104 has an elongated generally rectangular configuration in plan view with parallel beams forming the framework.

The majority of the carriages are of the standard chassis type and designated by the numeral 102 with the carriage of the type designated 104 being what is referred to as a short chassis type. The illustrated arrangement or system shows fifteen of the standard chassis carriages and one of the short chassis carriages. The system also has a powered chassis which will be subsequently discussed.

Figure 13:
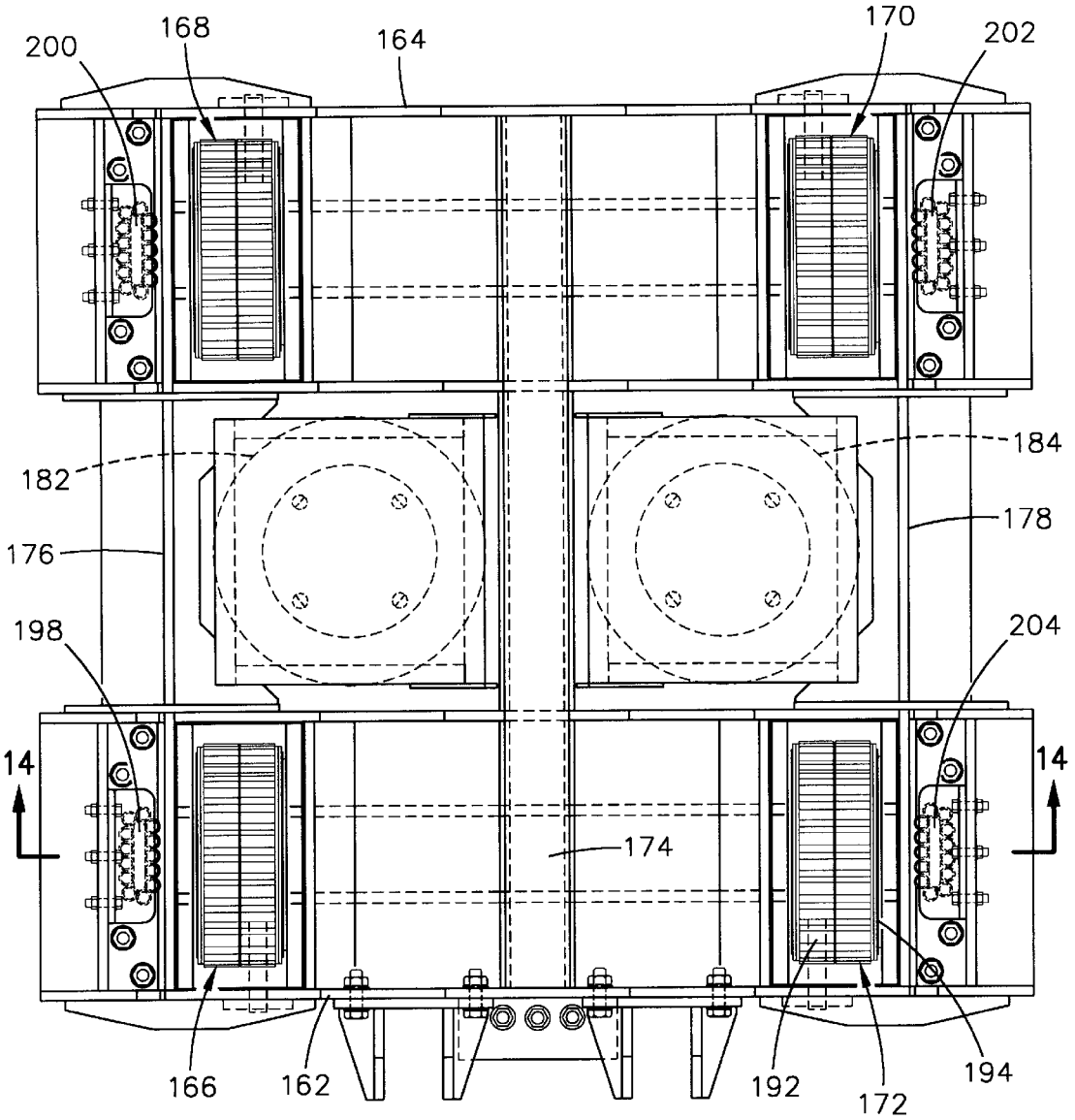
FIG. 13 is a top plan view of the bracket of FIG. 12 showing the support and guide rollers assembled to the frame.

The standard chassis carriages are all substantially identical and only one will be described. The chassis or carriage comprises a pair of laterally spaced diverging frame members 106 and 108 connected at one end forming a V configuration in plan view as shown in FIG. 6. This provides an arrangement wherein the carriages may be nestled partially within each other to provide accommodation within less space, as illustrated. The chassis is provided with hydraulically elevating struts 110, 112, 114 and 116, supporting four roller assemblies only two of which are shown, 118 and 120 in FIG. 10. These roller assemblies are constructed like those of the pier bracket illustrated in FIG. 13 and 14 and comprise a track or chain of rollers connected by chain links and mounted for rolling in a closed loop around the surface of a track of a support member. The roller track or chain rolls along a flat surface or track formed by the upper flat planar surface of the beams 48 and 50.

The hydraulic jacks or struts enable the carriage to set the elevation of the bridge segment and to provide a certain degree of levelling of the segment. Three additional jacks on top of the chassis which may be either hydraulic or screw 122, 124 and 126 (FIG. 6), are for engaging the adjacent web of the bridge segment to set the overall geometry of the web segment. They enable the further elevation tilting or transverse positioning of the respective segment.

The short chassis carriage 104 is constructed of a pair of parallel frame members 128 and 130, secured together at appropriate positions and with a suitable undercarriage, including hydraulic jacks or struts 132, 134, 136 and 138, supporting the frame on a plurality of roller tracks or chains, as in the prior embodiment not shown. The short chassis is also provided with suitable jacks 140 and 142 on the top thereof for engaging the underside of a segment, as previously described.

Figure 7:
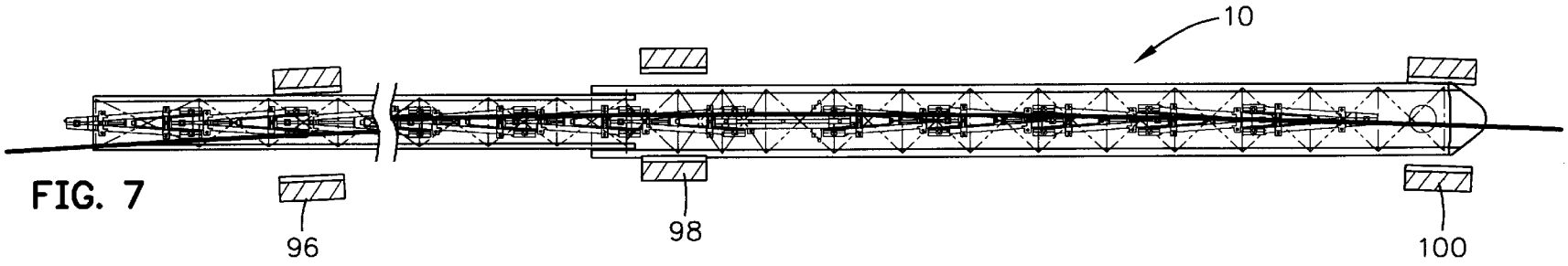
FIG. 7 is a view like FIG. 5 showing a different arrangement of the carriage vehicles

During movement of the erection system from one pier to another, the carriages are stowed in the girder assembly as illustrated in FIGS. 5 and 7. In a preferred arrangement the carriages are nestled together as illustrated and rolled back on the track inside the girder with a winch and cable system (not shown). Any number of segment erection sequences can be carried out and the short chassis is positioned within the girder assembly in accordance with that erection sequence. A number of (not shown) lift-out jacks are mounted inside the girder and positioned to lift out the carriages to provide the desired sequence of erection.

Figure 9:
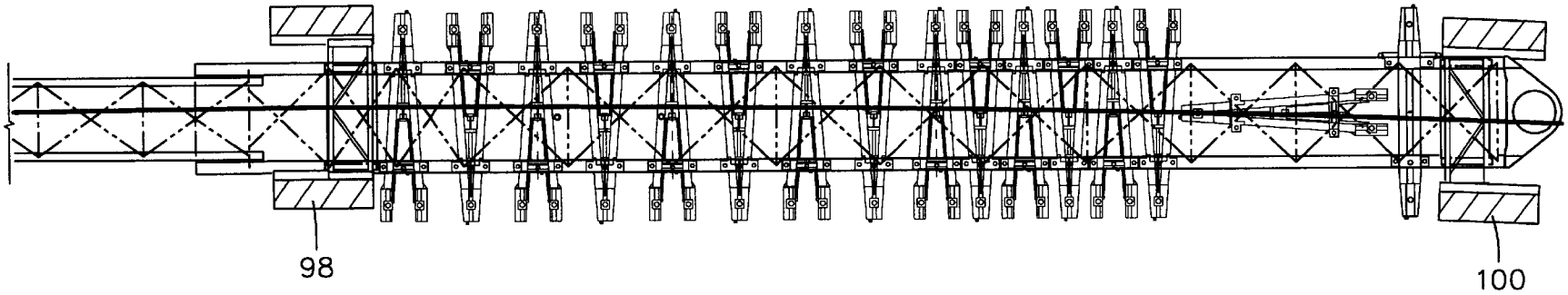
FIG. 9 is a plan view of FIG. 8.
Figure 10:
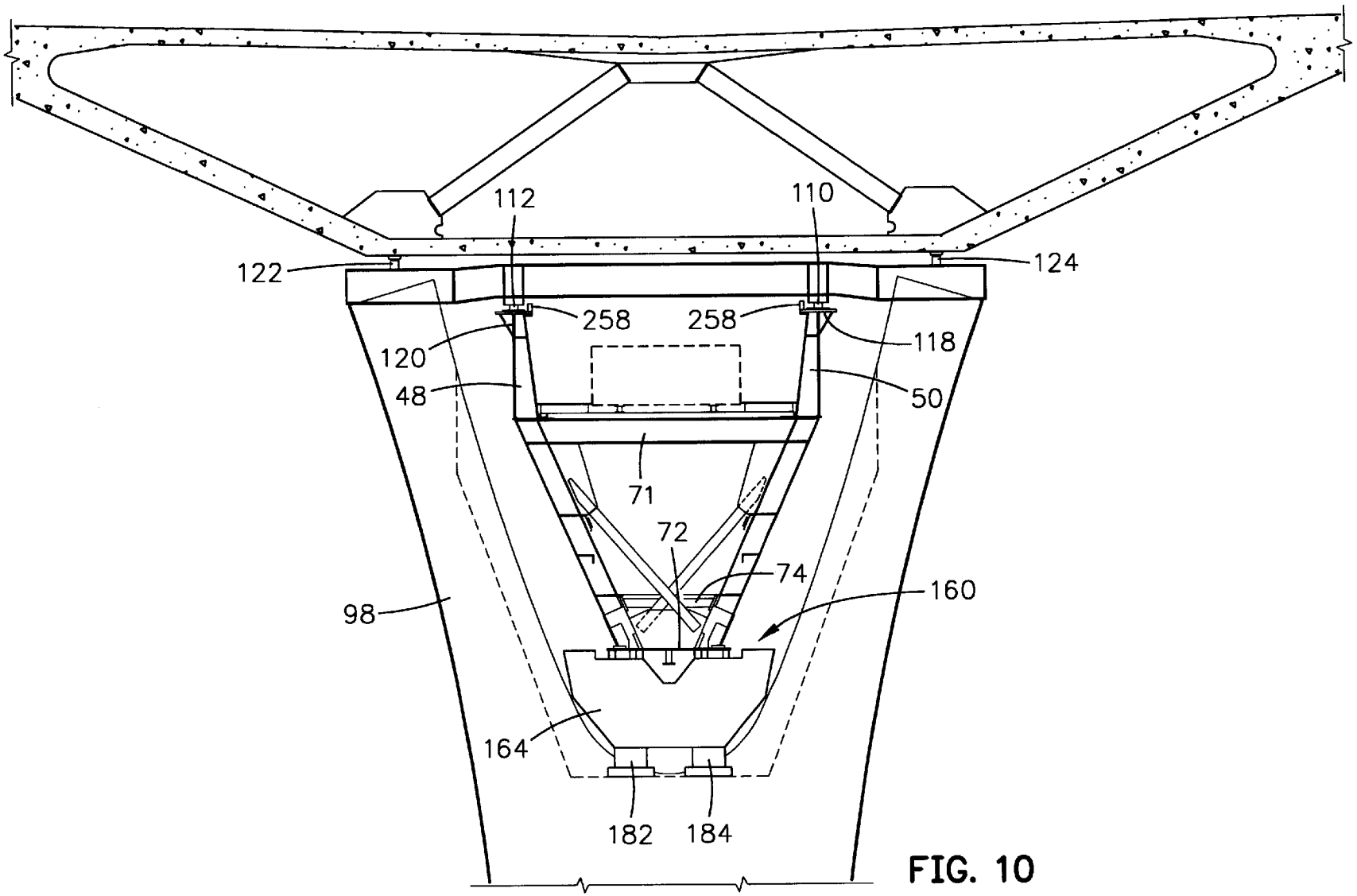
FIG. 10 is a section view taken on line 10—10 of FIG. 8.

Referring to FIG. 9, a top view illustrates the positioning of the carriages during the assembly process. As illustrated, the positioning and assembly of the bridge segment takes place over the plate girder section. The carriages are lifted out in the sequence or order of use with a lift-out jack and, as illustrated, are rotated transverse to the longitudinal axis of the girder section. The carriage is then loaded with a bridge span segment, as illustrated in FIG. 10, and the segment moved to the necessary position to engage and attach to the last assembled segment. As seen in FIG. 9, the carriages are arranged to extend in alternate directions across the axis of the girder section for engaging and supporting the bridge segments.

Figure 8:
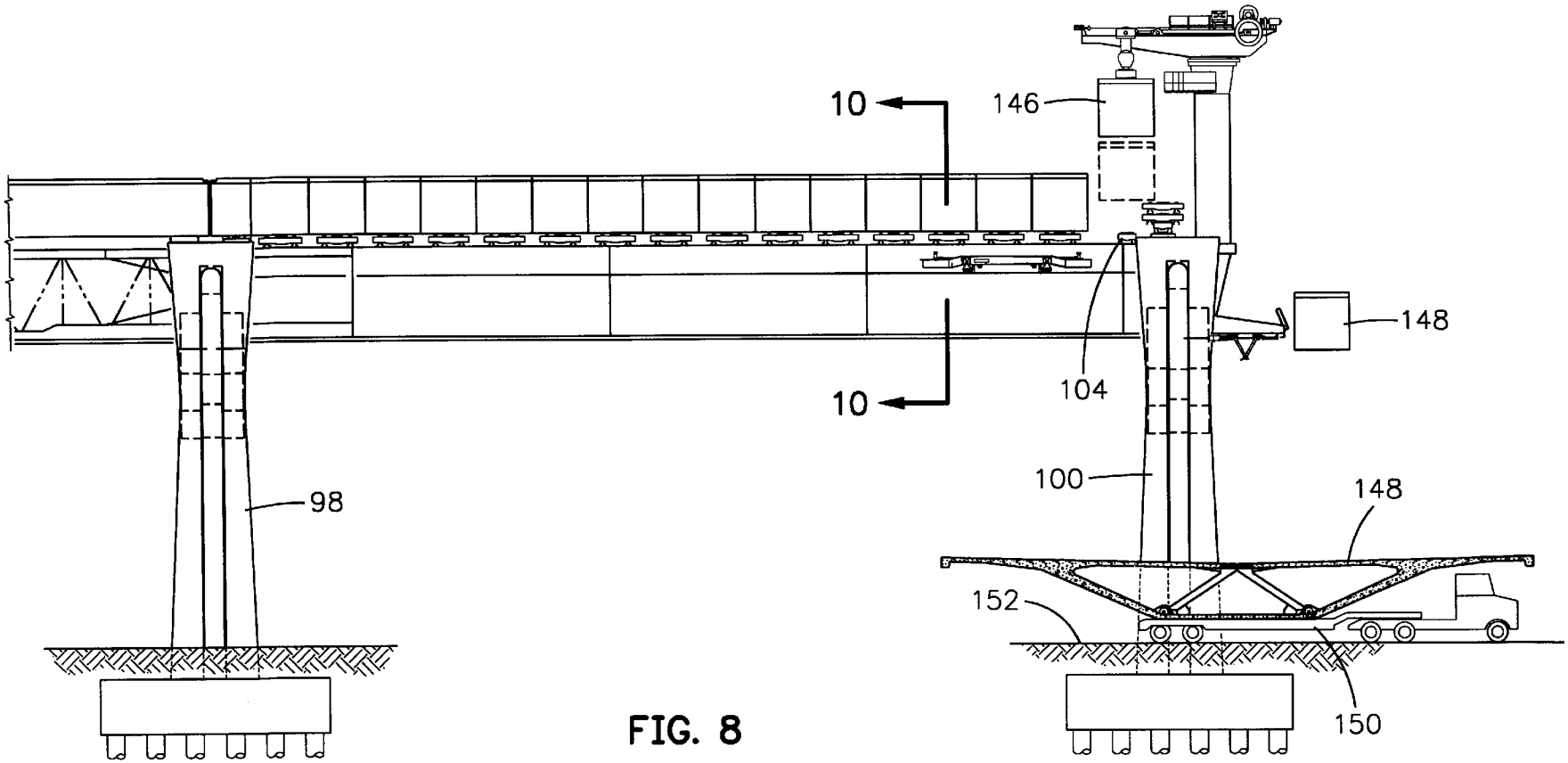
FIG. 8 is a side elevation view of the plate girder section of the invention shown in use.

As illustrated in FIG. 8, a plurality of bridge segments have been loaded onto carriages and moved in sequence into position between the piers 98 and 100. A bridge segment 146 is being supported by the crane and lowered into a position where it will be loaded on a short chassis 104 and moved into place for securing to the other segments for completing the span. A final segment 148 is shown supported on a flat-bed trailer at 150 at the base of the pier for subsequent lifting onto the support girder system. The flat-bed truck trailer operates from an existing road bed 152 for hauling the bridge segments to the site and in position picking up by the crane for positioning for assembly and bridge erection.

Referring to FIG. 10, a cross-section of the plate girder section is illustrated showing a bridge segment in position supported on a standard chassis with workmen shown on the upper and lower decks. A chassis is shown in the stowed position on the upper level and the inside of the plate girder section. The girder is supported on a bracket 160 mounted in the fork of the pier 98. The pier bracket is more fully described in FIGS. 12–14.

Figure 11:
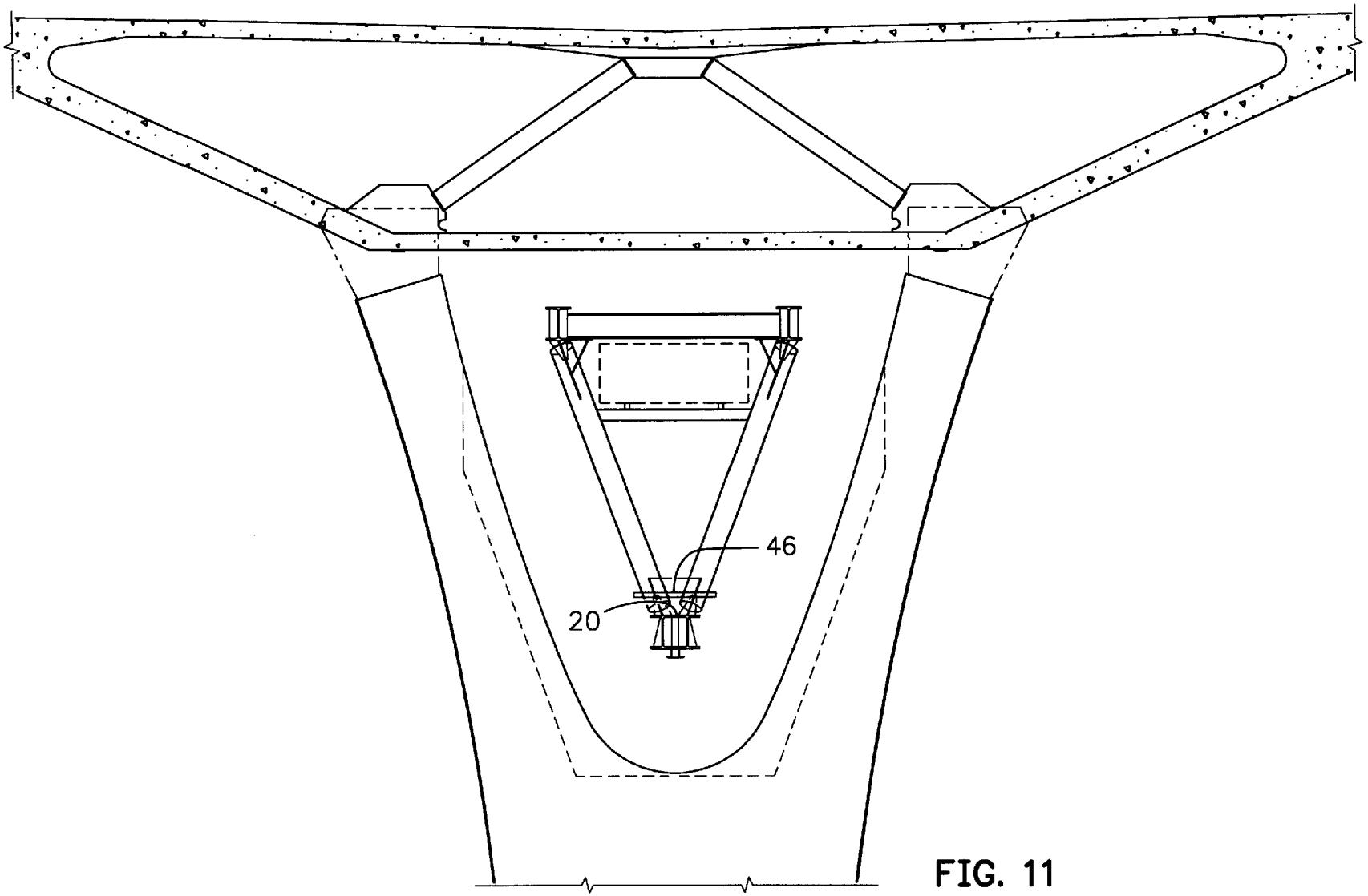
FIG. 11 is a top plan view of the plate girder section of the invention showing the carriage vehicles in position of use.

Referring to FIG. 11, a cross-section of the truss girder section is illustrated wherein the bridge segment has been put in place and showing a chassis in stowed position and a workman on the walkway. The girder is supported on the pier by a pier bracket (not shown). When the final segment 148 (FIG. 8) is lifted in position and the span has been post-tensioned, the girder and chassis will be underloaded from the weight of the span and the carriage rolled to the pick-up station to be turned 90° and lowered into the girder on the track running the length of the girder. The carriages will all be loaded inside the girder and rolled back and secured into a stowed position by a winch and cable system before launching of the girder to the next pier.

Figure 12:
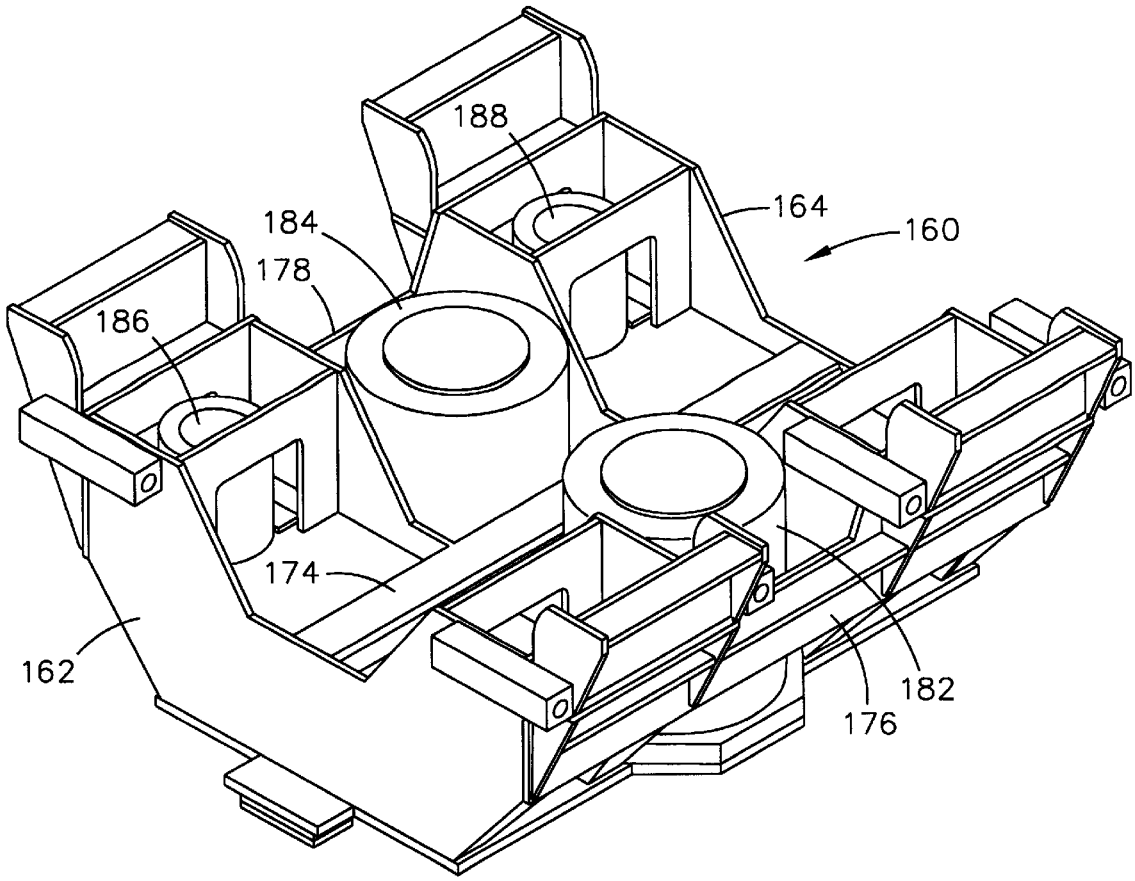
FIG. 12 is an isometric view of the frame and housing structure of the support bracket.

Referring to FIG. 12, a pier bracket designated generally by the numeral 160 for supporting the truss structure on the piers is illustrated. This bracket comprises a pair of spaced apart generally saddle shaped beams 162 and 164 with vertically extending legs having mounting recesses for mounting a plurality of support roller assemblies 166, 168, 170 and 172. The two beams 162 and 164 are tied together essentially by a central beam 174 and by side beams 176 and 178. The bracket has a pair of high capacity elevating jacks 182 and 184 for engaging the pier (FIG. 10) and raising the bracket relative to the pier. A pair of the roller assembly, such as 170 and 172 are mounted on a pair tilting jacks 186 and 188. This enables the support bracket to tilt the girder sections, when desired.

Figure 14:
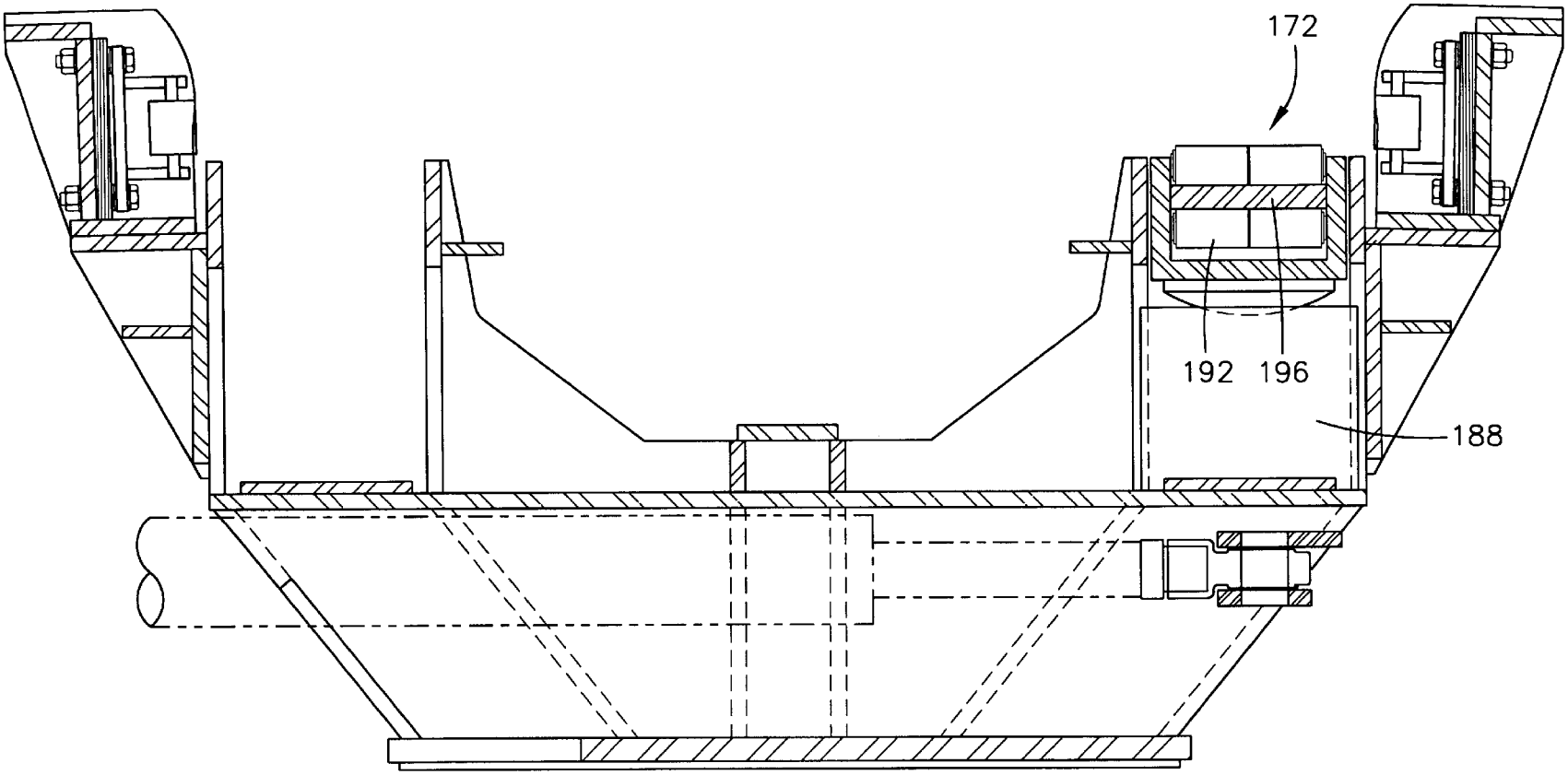
FIG. 14 is a section view taken generally on line 14—14 of FIG. 13.
Figure 15:
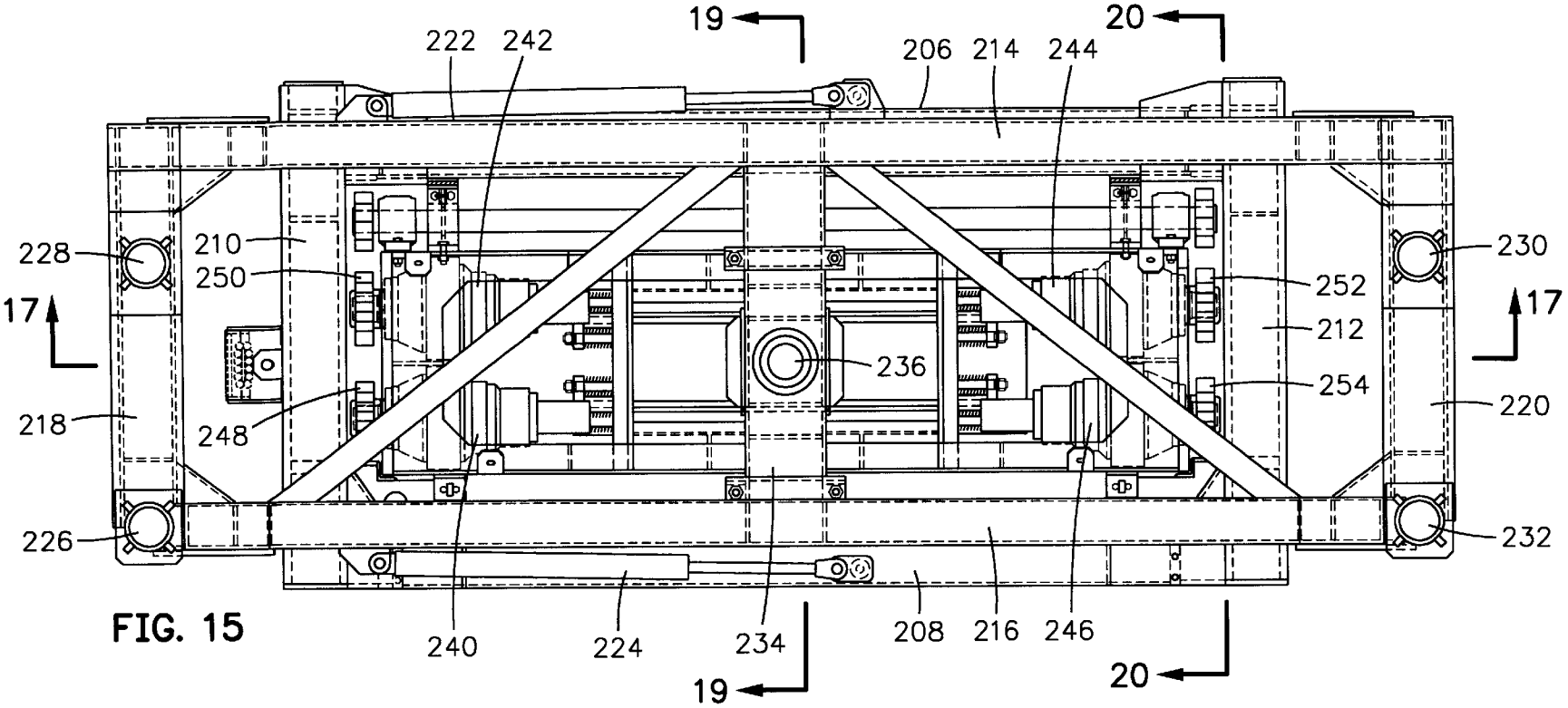
FIG. 15 is a top plan view of a motorized carriage.
Figure 16:
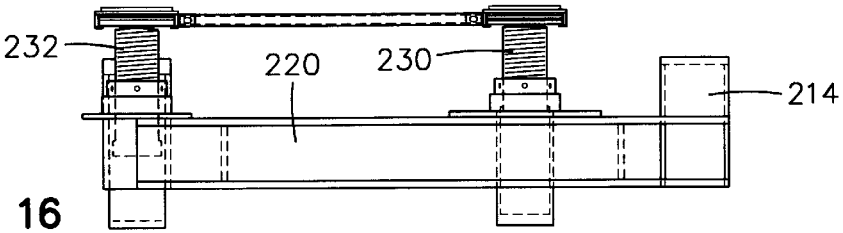
FIG. 16 is an end view of the embodiment of FIG. 15.

The roller assemblies, such as roller assembly 172 illustrated in FIG. 14, comprise a plurality of cylindrical roller elements or members connected together at their ends by chain link like members 192 and 194 and mounted to roll on a central flat planar support member 196. These roller assemblies engage the lower surface of plate or beam 72 (FIGS. 4 and 10) of the girder and support it for movement to the next pier. Each support bracket is also provided with laterally positioned guide roller assemblies 198, 200, 202 and 204. These engage the side edges of the beams 20 or 72 and restrain the girder sections and guide them between the piers.

Referring now to FIGS. 15–20, a motorized carriage and its construction and arrangement is illustrated. The motorized carriage comprises a lower primary frame of a generally rectangular configuration and comprising a pair of cross beams 206 and 208 with end beams 210 and 212 forming a rectangular frame. An upper generally rectangular frame member formed of a pair of transverse beams 214 and 216 connected at their ends by end beams 218 and 220. This upper frame is movably mounted on the lower frame for skewing (or lateral movement) and positioning bridge segments. The upper frame is movable relative to the lower frame by means of a pair of hydraulic rams or jacks 222 and 224. These enable the upper frame to be positioned laterally with respect to the lower frame. A plurality of jacks 226, 228, 230 and 232 are mounted on the upper frame for engagement with and for tilting, raising and positioning of the bridge segments. These jacks may be screw jacks or hydraulic jacks or any other suitable jacks.

Figure 17:
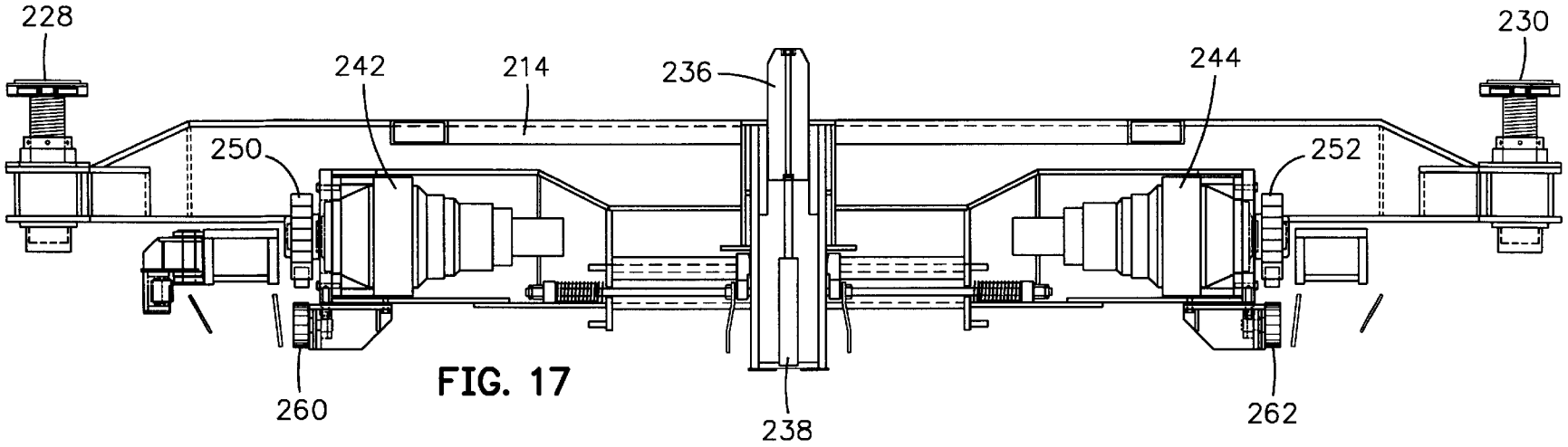
FIG. 17 is a view taken generally on line 17—17 of FIG. 15.

A center structural beam of the upper frame 234 mounts a connect pin or shear pin 236 for connecting or fixing the carriage to the bridge structure during and for movement of the girder assembly. This pin is extended and extracted in a suitable manner, such as by a hydraulic piston or motor 238 as shown in FIG. 17 into a suitable connecting socket in the bridge segment.

The powered carriage is powered by four hydraulic motors 240, 242, 244 and 246. These motors each drive a pinion gear 248, 250, 252 and 254, which drivingly engage a rack, shown at 258 in FIGS. 10 and 20 on plates or beams 48 and 50. The pair of racks 258 are mounted on the upper tracks on the girder assembly and functions to provide a driving, connection between the driving carriage and the girder assembly. A pair of counter rollers or wheels 260 and 262 engage a lower surface of the flange of the upper plate or beams 48 and 50 of girder section to retain the driving gears in driving engagement with the rack.

Figure 18:
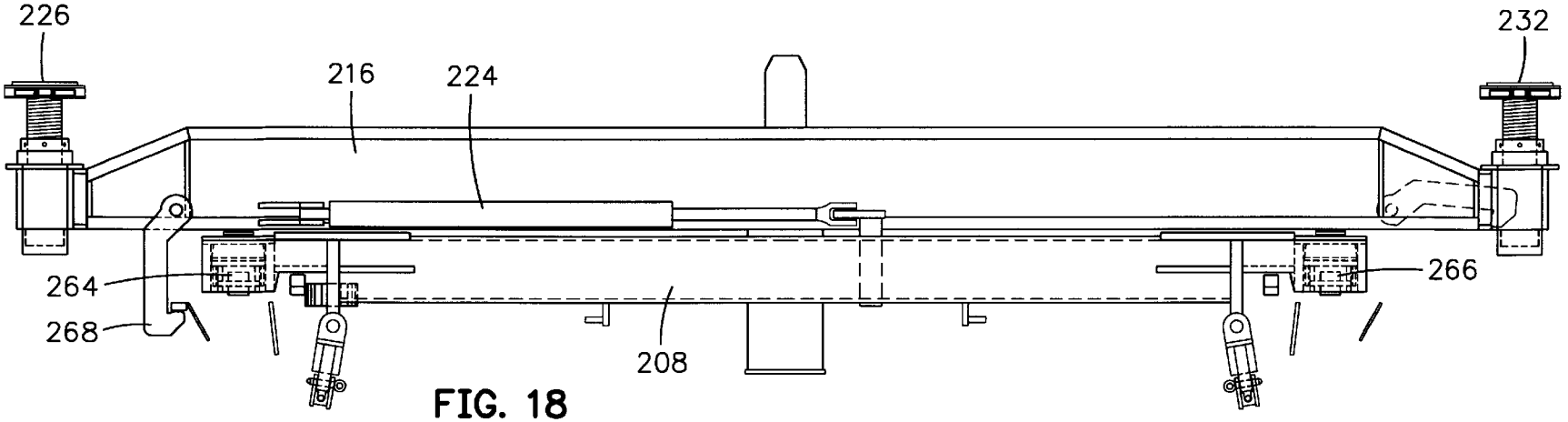
FIG. 18 is a front elevation view of the carriage of FIG. 15.
Figure 19:
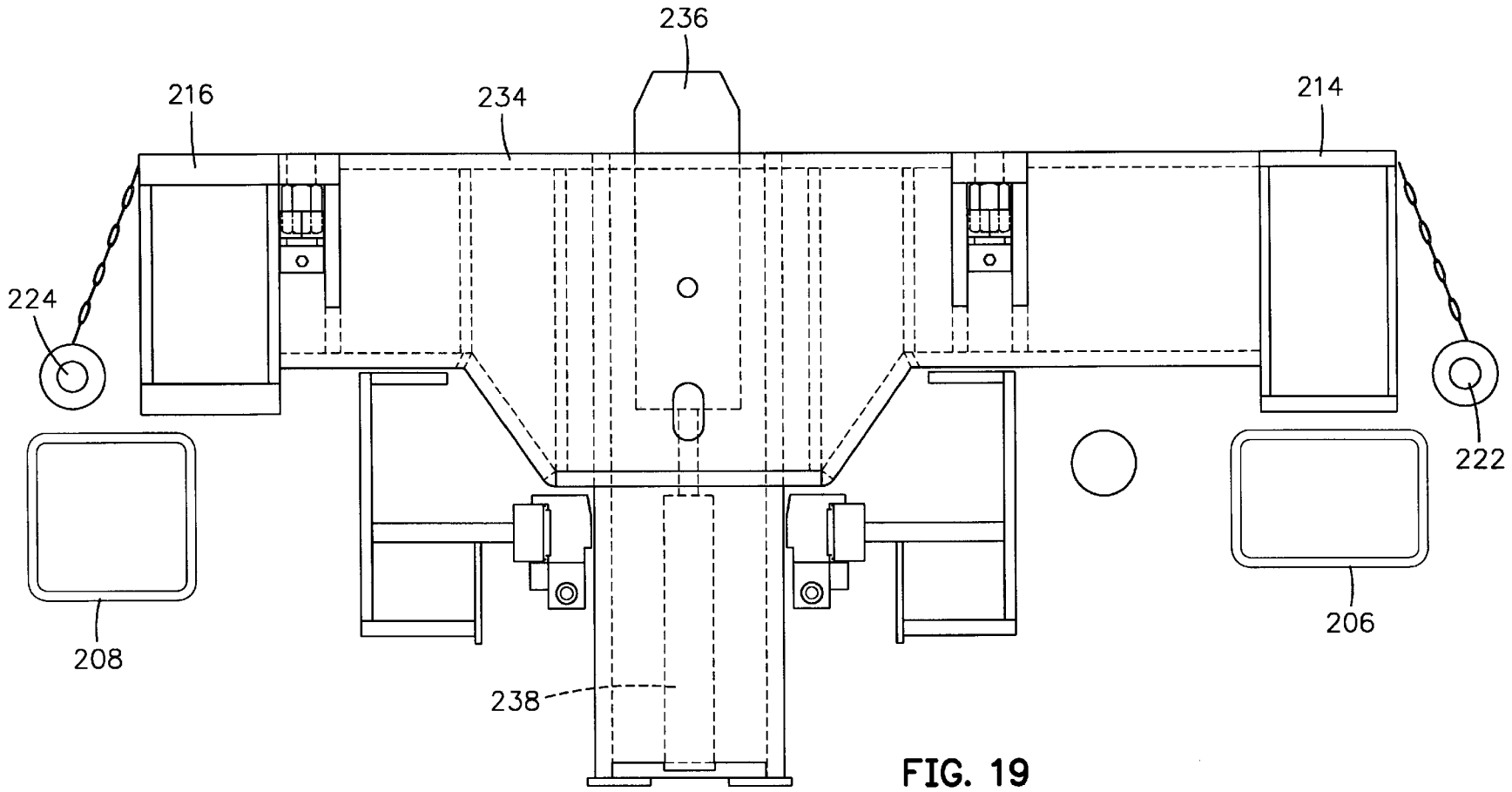
FIG. 19 is a view taken generally on line 19—19 of FIG. 15.
Figure 20:
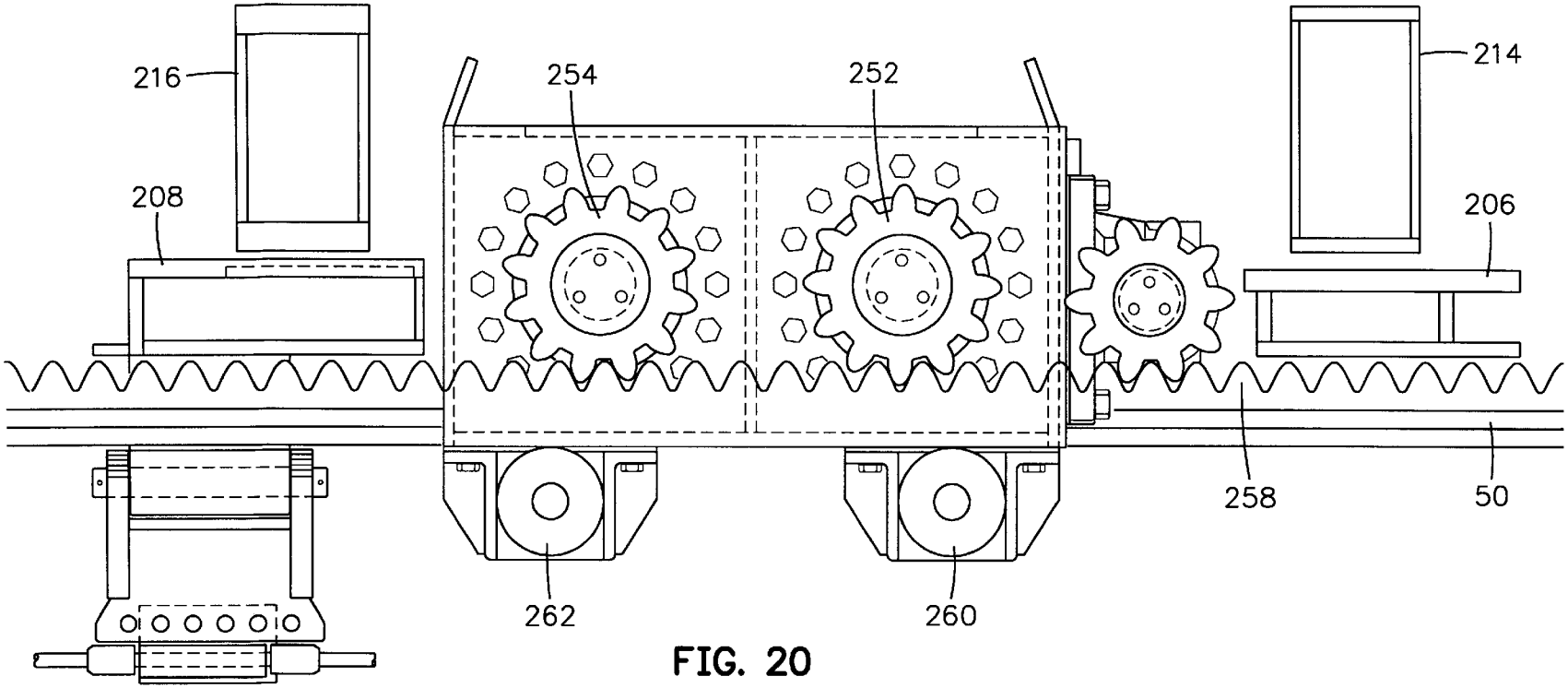
FIG. 20 is a section view taken on line 20—20 of FIG. 15.

Referring to FIG. 18, the lower frame 208 is provided at each corner with a support roller assembly, only two of which, 264 and 266, are shown. These rest on and roll on the tracks defined by the flanges of the upper beams of the girder assembly. The carriage may also be provided with a hold-down hook 268, as shown in FIG. 18.

While I have illustrated my invention by means of a specific embodiment, it is to be understood that numerous changes and modifications may be made therein without departing from the spirit and scope of the invention, as defined in the appended claims.

I claim:

1. An apparatus for span-by-span bridge construction, comprising:

an elongated girder assembly for spanning between adjacent bridge piers for supporting precast bridge segments during assembly, said girder assembly comprising longitudinally disposed first open beam section and second enclosed section, said second section forming an enclosed work area;

pier bracket means for attachment to a pier and having roller means for engagement with and support of said girder assembly for movement between at least two piers; and at least one carriage vehicle on said girder assembly moveable between a working position of supporting the bridge segments during assembly of multiple segments and a stowage position.

2. An apparatus according to claim 1 wherein said girder assembly first section is adapted for longitudinally extending between a first and a second bridge pier and said second elongated section is adapted for extending between said second bridge pier and a third bridge pier.

3. An apparatus according to claim 2 wherein:

said first open beam section is a truss section having upper and lower longitudinally extending interconnected beams; and said second enclosed section is a plate section formed by upper and lower longitudinally extending plates reinforced by beams.

4. An apparatus according to claim 1 wherein said first open beam section is a truss having upper and lower longitudinally extending interconnected girders.

5. An apparatus according to claim 1 wherein said girder assembly having a pair of spaced apart upper tracks and a lower track, said upper tracks defining said working position and said lower track defining said stowage position.

6. An apparatus according to claim 5 wherein said carriage vehicle is adapted to span the width of said girder assembly and includes a plurality of roller assemblies for engagement with and support on said upper tracks and on said lower track.

7. An apparatus according to claim 6 wherein said carriage vehicle includes hydraulic jacks on said plurality of roller assemblies for vertically positioning a bridge segment, and a plurality of jacks on top of said carriage for setting the level of said segment.

8. An apparatus according to claim 7 wherein said carriage vehicle includes a pair of roller assemblies for one of said upper tracks and a single roller for the other of said upper tracks.

9. An apparatus according to claim 5 wherein said carriage vehicle includes a pair of roller assemblies for one of said upper tracks and a single roller for the other of said upper tracks.

10. An apparatus according to claim 1 further comprising a motorized carriage for detachable attachment to a bridge structure and driving engagement with said truss for launching said truss to a next pier.

11. An apparatus for span-by-span bridge construction, comprising:

an elongated girder assembly for spanning between adjacent bridge piers for supporting precast bridge segments during assembly;

pier bracket means for attachment to a pier shaft and having roller means for engagement with and support of said girder assembly for movement between piers;

at least one carriage vehicle on said girder assembly moveable between a working position of supporting the bridge segments during assembly of multiple segments and a stowage position;

a motorized carriage for launching said truss to a next pier, said motorized carriage comprising:

a rectangular frame having roller assemblies for engagement with planar tracks on each side of said girder assembly;

a motor on each side of said frame, each motor having a pinion gear for driving engagement with an elongated rack adjacent said tracks; and means for releasably connecting said frame to a bridge segment.

12. An erection apparatus for precast concrete segment span-by-span bridge construction, comprising:

an elongated plate girder assembly for spanning between at least two adjacent bridge piers for supporting precast bridge segments during assembly, said girder assembly comprising a pair of laterally spaced longitudinally extending upper plates and a single centrally positioned lower plate, structural stiffening means secured between said plates for stiffening said plates, a pair of spaced apart upper tracks on the top of said upper plates and an interior track on the interior of said girder assembly;

pier bracket means for attachment to a pier and having roller means for engagement with and support of said girder assembly for enabling movement of said girder assembly between adjacent piers; and at least one carriage vehicle adapted to span the width of said girder assembly and includes a plurality of roller assemblies for engagement with and support on said upper tracks on said girder assembly; and moveable between a working position of supporting the bridge segments on said upper track during assembly of multiple bridge segments and a stowage position on said interior track during movement of said girder assembly between said piers.

13. An apparatus according to claim 12 wherein said girder assembly comprises a first section for spanning between a first and second pier and a second section for spanning between said second pier and a third pier.

14. An apparatus according to claim 13 wherein said first section has a truss assembly construction and a triangular cross section, and said second section has an enclosed plate construction and an upper rectangular and lower triangular cross section.

15. An apparatus according to claim 12 further comprising a motorized carriage vehicle on said girder assembly moveable operative in a working position for launching said girder assembly to a next pier.

16. An apparatus for precast concrete segment span-by-span bridge construction, comprising:

an elongated plate girder assembly for spanning between adjacent bridge piers for supporting precast bridge segments during assembly, said girder assembly comprising a pair of laterally spaced longitudinally extending upper plates defining tracks, an elongated rack adjacent said tracks and a single centrally positioned lower plate, structural stiffening means secured between said plates for stiffening said plates, an upper track on the top of said upper plates and an interior track on the interior of said girder assembly;

pier bracket means for attachment to a pier shaft and having roller means for engagement with and support of said girder assembly for movement of said girder assembly between adjacent piers; and at least one carriage on said girder assembly moveable between a working position of supporting the bridge segments on said upper tracks during assembly of multiple bridge segments and a stowage position on said interior track during movement of said girder assembly between said piers;

a motorized carriage comprising:

a rectangular frame having roller assemblies for engagement with said tracks on each side of said girder assembly;

a motor on each side of said frame, each motor having a pinion gear for driving engagement with said elongated rack said tracks; and means for releasably connecting said frame to a bridge segment.

17. A method of span-by-span bridge construction, the method comprising the steps of:

selecting an elongated girder assembly having a pair of spaced apart upper tracks and an interior track and mounting said elongated girder assembly between a pair of adjacent bridge piers for supporting precast bridge segments during assembly;

selecting and mounting a plurality of pier brackets having roller means for engagement with and support of said girder assembly for movement between at least two piers to a pair of spaced apart pier shafts; and selecting a plurality of carriages adapted to span the width of said girder assembly and includes a plurality of roller assemblies for engagement with and support on said upper tracks and mounting said plurality of carriages on said girder moveable between a working position of supporting the bridge segments during assembly of multiple segments and a stowage position on said interior track during movement of said girder assembly between said piers.

18. A method of span-by-span bridge construction, comprising:

selecting an elongated girder assembly having a rack and pinon drive and mounting said elongated girder assembly between a pair of adjacent bridge piers for supporting precast bridge segments during assembly;

selecting and mounting a plurality of pier brackets having roller means for engagement with and support of said girder assembly for movement between piers to a pair of spaced apart pier shafts;

selecting and mounting a plurality of chassis on said girder moveable between a working position and a stowage position of supporting the bridge segments during assembly of multiple segments;

moving said girder assembly between adjacent piers by selecting and mounting a motorized carriage on said girder assembly;

drivingly connecting said motorized carriage to said girder assembly by means of a said rack and pinon drive;

fixing said carriage to a bridge span; and operating a motor on said carriage.

19. A method according to claim 18 wherein said motorized carriage is selected to comprise:

a rectangular frame having roller assemblies for engagement with planar tracks on each side of said girder assembly;

a motor on each side of said frame, each motor having a pinion gear for driving engagement with an elongated rack adjacent said tracks; and means for releasably connecting said frame to a bridge segment.

* * * * *